US008757438B1

(12) United States Patent
Garcia

(10) Patent No.: US 8,757,438 B1
(45) Date of Patent: Jun. 24, 2014

(54) MULTIPLE COMPARTMENTED AND CONDIMENT DISPENSING APPARATUS

(71) Applicant: Hector Garcia, North Bergen, NJ (US)

(72) Inventor: Hector Garcia, North Bergen, NJ (US)

( * ) Notice: Subject to any disclaimer, the term of this patent is extended or adjusted under 35 U.S.C. 154(b) by 0 days.

(21) Appl. No.: 13/626,031

(22) Filed: Sep. 25, 2012

(51) Int. Cl.
*B65D 35/22* (2006.01)

(52) U.S. Cl.
USPC ..... 222/94; 222/325; 222/105; 222/132; 222/135; 222/153.01; 220/835; 220/326; 220/495.05; 220/495.03; 220/507; 220/555

(58) Field of Classification Search
USPC ..... 222/92, 94, 95, 96, 103, 105, 129, 132, 222/135, 143, 144.5, 145.3, 145.1, 153.01, 222/153.13, 325, 326, 327, 330, 331; 220/835, 834, 833, 326, 495.03, 220/495.06, 507, 553, 555; 99/460, 461; 239/549
See application file for complete search history.

(56) References Cited

U.S. PATENT DOCUMENTS

| | | | | | |
|---|---|---|---|---|---|
| 1,760,945 | A * | 6/1930 | Grigsby | 222/105 |
| 2,515,440 | A * | 7/1950 | Cicero | 222/103 |
| 2,568,286 | A * | 9/1951 | Littlefield | 222/103 |
| 2,643,029 | A * | 6/1953 | Chapman et al. | 222/103 |
| 2,763,401 | A * | 9/1956 | Buras, Jr. | 222/103 |
| 2,781,951 | A * | 2/1957 | Hanford | 222/103 |
| 3,197,071 | A * | 7/1965 | Kuster | 222/94 |
| 3,768,699 | A * | 10/1973 | Robe, Jr. | 222/103 |
| 4,324,348 | A * | 4/1982 | Johnson et al. | 222/181.2 |
| 4,326,647 | A * | 4/1982 | Pool | 222/103 |
| 4,565,303 | A * | 1/1986 | Gilbertson | 222/103 |
| 4,880,409 | A * | 11/1989 | Bergkvist et al. | 604/73 |
| 4,991,615 | A * | 2/1991 | Szlaga et al. | 137/43 |
| 5,105,984 | A * | 4/1992 | Kazimir | 222/103 |
| 5,137,178 | A * | 8/1992 | Stokes et al. | 222/94 |
| 5,810,205 | A * | 9/1998 | Kohen | 222/103 |
| 5,862,949 | A * | 1/1999 | Markey et al. | 222/143 |
| 6,554,164 | B1 * | 4/2003 | Jones | 222/105 |
| 6,669,055 | B1 * | 12/2003 | Coleman et al. | 222/103 |
| 6,695,174 | B2 * | 2/2004 | Sørensen et al. | 222/214 |
| 6,783,514 | B2 * | 8/2004 | Tovey et al. | 604/191 |
| 7,946,452 | B2 * | 5/2011 | Hantman et al. | 222/94 |
| 8,240,521 | B2 * | 8/2012 | Py | 222/492 |
| 8,240,934 | B2 * | 8/2012 | Py et al. | 401/265 |
| 2008/0149126 | A1 * | 6/2008 | Abergel | 132/200 |
| 2010/0288672 | A1 * | 11/2010 | Murphy | 206/538 |

* cited by examiner

*Primary Examiner* — Paul R Durand
*Assistant Examiner* — Randall Gruby
(74) *Attorney, Agent, or Firm* — Kyle A. Fletcher, Esq.

(57) ABSTRACT

The multiple compartmented and condiment dispensing apparatus includes a housing into which a plurality of packet compartments are arranged. The packet compartments open to enable a refill packet to be inserted and loaded for use in dispensing a condiment therefrom. The packet compartments are each in fluid communication with a spout provided on a distal end of the housing. The spout includes a plurality of channels that each connects via ductwork to the packet compartments where the refill packets connect. The refill packets dispense a condiment through the respective ductwork and out a channel of the spout. Each packet compartment includes a loader door that is pivotally engaged with respect to the housing, and which can open outwardly to enable the refill packets to be inserted and removed from the respective packet compartment.

6 Claims, 4 Drawing Sheets

MULTIPLE COMPARTMENTED AND CONDIMENT DISPENSING APPARATUS

CROSS REFERENCES TO RELATED APPLICATIONS

Not Applicable

STATEMENT REGARDING FEDERALLY SPONSORED RESEARCH

Not applicable

REFERENCE TO APPENDIX

Not Applicable

BACKGROUND OF THE INVENTION

A. Field of the Invention

The present invention relates to the field of condiment dispensers, more specifically, improvements to a multiple compartment and condiment dispensing apparatus.

B. Discussion of the Prior Art

As will be discussed immediately below, no prior art discloses a condiment dispenser which uses refill packets, and of which the refill packets are individually loaded into one of a plurality of packet compartments for dispensing therefrom; wherein the packet compartments are integrated into a main housing; wherein the main housing includes a spout at a distal end; wherein the spout includes multiple channels that are each in fluid communication with one of the packet compartments such that upon loading a refill packet therein, said refill packet may dispense a condiment through the spout when actuated via depression of the loader door; wherein each packet compartment includes a spring-loaded loader door that opens outwardly to enable the refill packet to be inserted therein; wherein the loader door may rotate and lock in a closed state whereby the refill packet is left unused therein; where upon inward depression of the loader door shall effect a squeezing action to the refill packet, which shall dispense the condiment stored therein through the spout; wherein the condiment dispenser shall be able to dispense multiple condiments individually or simultaneously.

The Lykes Patent (U.S. Pat. No. 2,934,242) discloses a multiple compartment condiment dispenser. However, the condiment dispenser does not use refill packets, and is not designed to be used with viscious fluid materials such as ketchup. Additionally, the dispenser does not allow for multiple condiments to be dispensed at the same time.

The Jungmann Pat. (U.S. Pat. No. 3,229,856) discloses a condiment dispenser having a plurality of condiment chambers. However, the condiment dispenser does not use refill packets, and is not designed to be used with viscious fluid materials such as ketchup. Additionally, the dispenser does not allow for multiple condiments to be dispensed at the same time.

The Usen et al. patent (U.S. Pat. No. 5,628,429) discloses a squeezable tube for dispensing a viscous fluid material such as ketchup and which has multiple chambers and spouts for dispensing multiple fluids at the same time. However, the dispensing tube does not use refill packets, and does not use a spring loaded lock button and lock pin system for loading refill packets.

The Dukess Patent (U.S. Pat. No. 3,506,157) discloses a squeeze tube for a condiment substance in which the tube has multiple compartments for housing and dispensing multiple different condiments. However, the dispensing tube does not use refill packets, and does not use a spring loaded lock button and lock pin system for loading refill packets.

The Sokolsky et al. patent (U.S. Pat. No. 6,863,178) discloses an arrangement of individual condiment serving packets in an outer container having an approximately cylinderical container with at least four dual-packet sheets within said container. However, the dispenser does not use a packet chamber to refill the compartments, and does not use a spring loaded lock button and lock pin system for loading refill packets.

The Ledewitz Patent (U.S. Design Patent No. 214,549) illustrates an ornimental design for a plural compartment bottle. However, the dispensing tube does not use refill packets and does not use a spring loaded lock button and lock pin system for loading refill packets.

The Burke Paten (U.S. Design Patent No. 517,866) illustrates a design for a two compartment condiment dispenser. However, the dispensing tube does not use refill packets, and does not use a spring loaded lock button and lock pin system for loading refill packets.

While the above-described devices fulfill their respective and particular objects and requirements, they do not describe a condiment dispenser which uses refill packets, and of which the refill packets are individually loaded into one of a plurality of packet compartments for dispensing therefrom; wherein the packet compartments are integrated into a main housing; wherein the main housing includes a spout at a distal end; wherein the spout includes multiple channels that are each in fluid communication with one of the packet compartments such that upon loading a refill packet therein, said refill packet may dispense a condiment through the spout when actuated via depression of the loaded door; wherein each packet compartment includes a spring-loaded loader door that opens outwardly to enable the refill packet to be inserted therein; wherein the loader door may rotate and lock in a closed state whereby the refill packet is left unused therein; where upon inward depression of the loader door shall effect a squeezing action to the refill packet, which shall dispense the condiment stored therein through the spout; wherein the condiment dispenser shall be able to dispense multiple condiments individually or simultaneously. In this regard, the multiple compartment and condiment dispensing apparatus departs from the conventional concepts and designs of the prior art.

SUMMARY OF THE INVENTION

The multiple compartmented and condiment dispensing apparatus includes a housing into which a plurality of packet compartments are arranged. The packet compartments open to enable a refill packet to be inserted and loaded for use in dispensing a condiment therefrom. The packet compartments are each in fluid communication with a spout provided on a distal end of the housing. The spout includes a plurality of channels that each connect via ductwork to the packet compartments where the refill packets connect. The refill packets dispense a condiment through the respective ductwork and out a channel of the spout. Each packet compartment includes a loader door that is pivotally engaged with respect to the housing, and which can open outwardly to enable the refill packets to be inserted and removed from the respective packet compartment. The loader doors can rotate and lock in a closed state whereby the refill packet is stored therein and in an unused state. The loader doors can thereafter rotate inwardly in order to squeeze the refill packet thereby dispensing the respective condiment from the spout.

An object of the invention is to provide a multi-compartment and dispensing apparatus whereby a plurality of condiments are individually loaded, stored until use, and either individually or simultaneously dispensed.

Another object of the invention is to provide an apparatus that utilizes refill packets that can be loaded and unloaded as needed.

A further object of the invention is to provide a plurality of compartment packets that are arranged in the housing, and which individually open to allow for loading of a refill packet.

Another object of the invention is to provide a loader door that opens outwardly to enable loading of and exchanging of refill packets as needed.

An even further object of the invention is to provide a loader door that also closes to a locked state whereby the refill packet is stored therein until needed.

An other object of the invention is to enable the loader doors to rotate further inwardly in order to squeeze the refill packet stored within, and during which shall dispense a respective condiment there from.

Another object of the invention is to include a single spout that includes multiple channels that individually connect via ductwork to a condiment compartment whereby a refill packet is able to connect thereto.

These together with additional objects, features and advantages of the multiple compartmented and condiment dispensing apparatus will be readily apparent to those of ordinary skill in the art upon reading the following detailed description of presently preferred, but nonetheless illustrative, embodiments of the multiple compartmented and condiment dispensing apparatus when taken in conjunction with the accompanying drawings.

In this respect, before explaining the current embodiments of the multiple compartmented and condiment dispensing apparatus in detail, it is to be understood that the multiple compartmented and condiment dispensing apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multiple compartmented and condiment dispensing apparatus.

It is therefore important that the claims be regarded as including such equivalent construction insofar as they do not depart from the spirit and scope of the multiple compartmented and condiment dispensing apparatus. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

Figure 1:
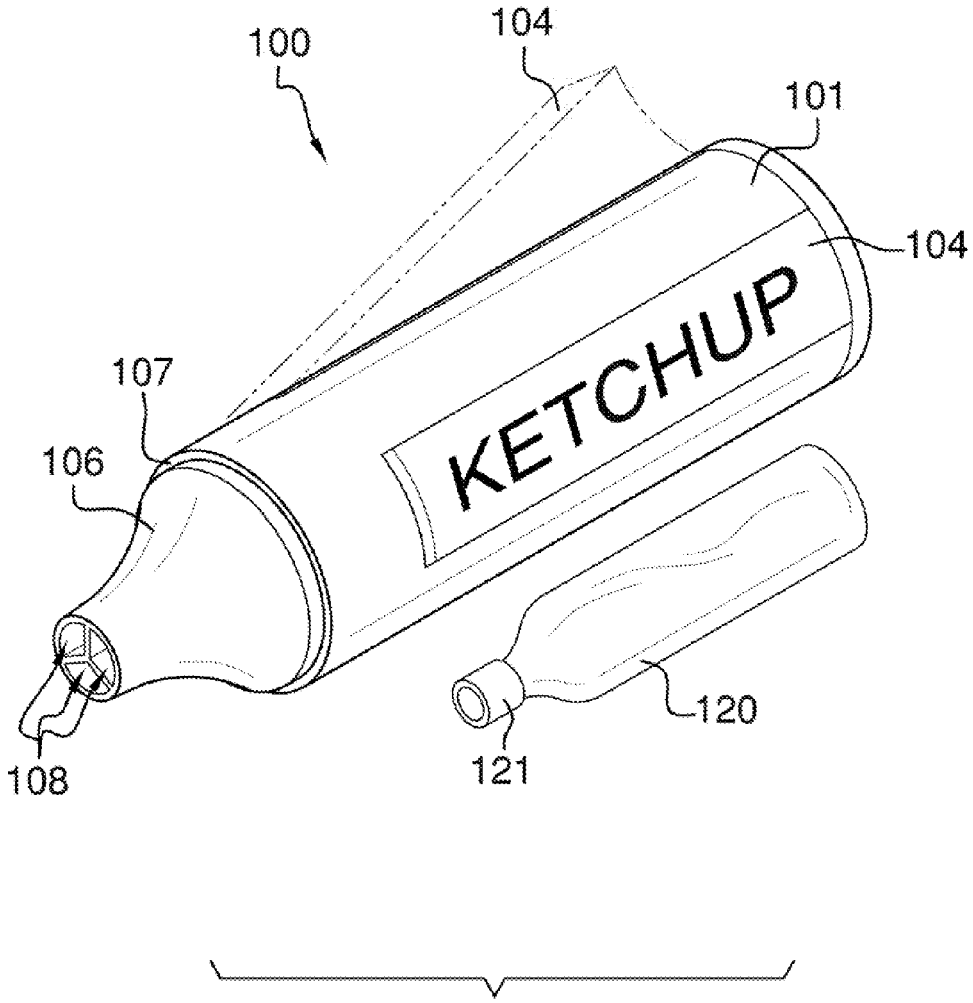
FIG. 1 illustrates a perspective view of the multiple compartmented and condiment dispensing apparatus wherein a refill packet is removed and placed adjacent the housing.
Figure 2:
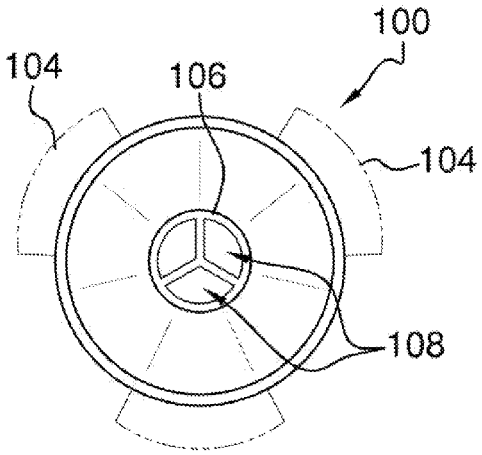
FIG. 2 illustrates an end view of the spout, and dashed lines indicating the rotational movement of the loader doors outwardly.
Figure 3:
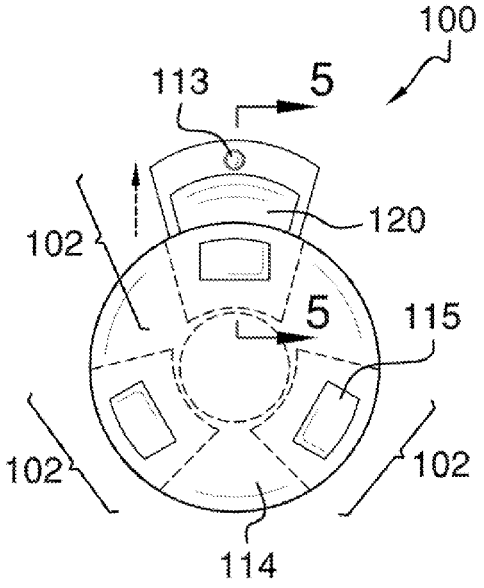
FIG. 3 illustrates an opposing end view of the housing whereby the lock buttons are depicted as well as a loader door rotated outwardly and within which a refill packet is located.
Figure 4:
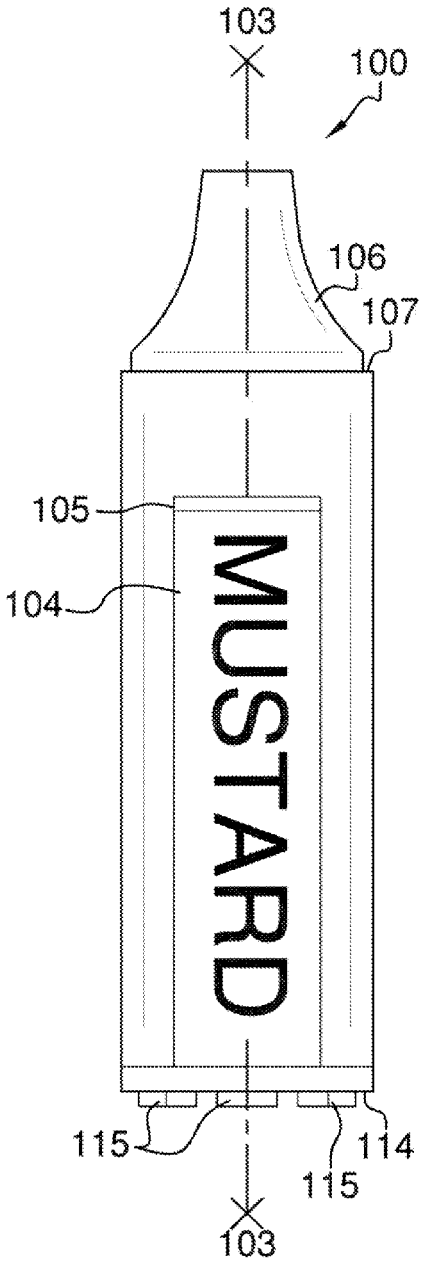
FIG. 4 illustrates a side view of the housing with the lock buttons extending there below, and with a profile of the spout thereon.
Figure 5A:
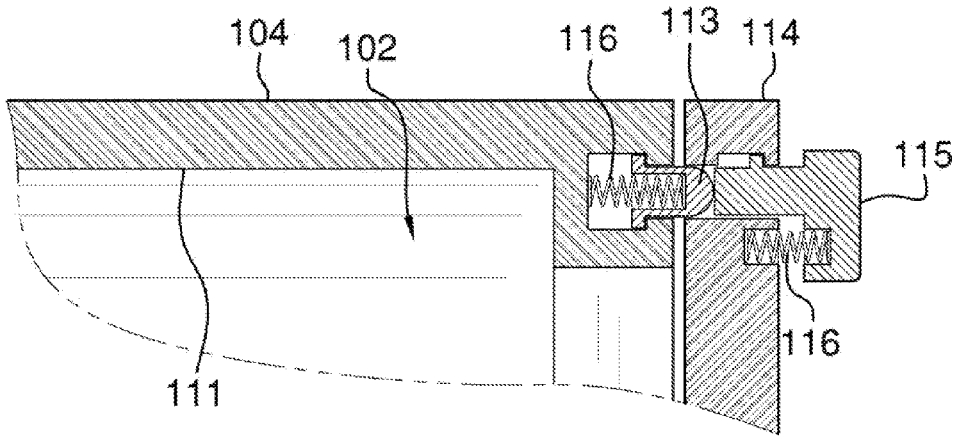
FIG. 5A illustrates a cross-sectional view along line 5-5 in FIG. 1 wherein the lock button is engaged against a lock pin provided on a respective loader door.
Figure 5B:
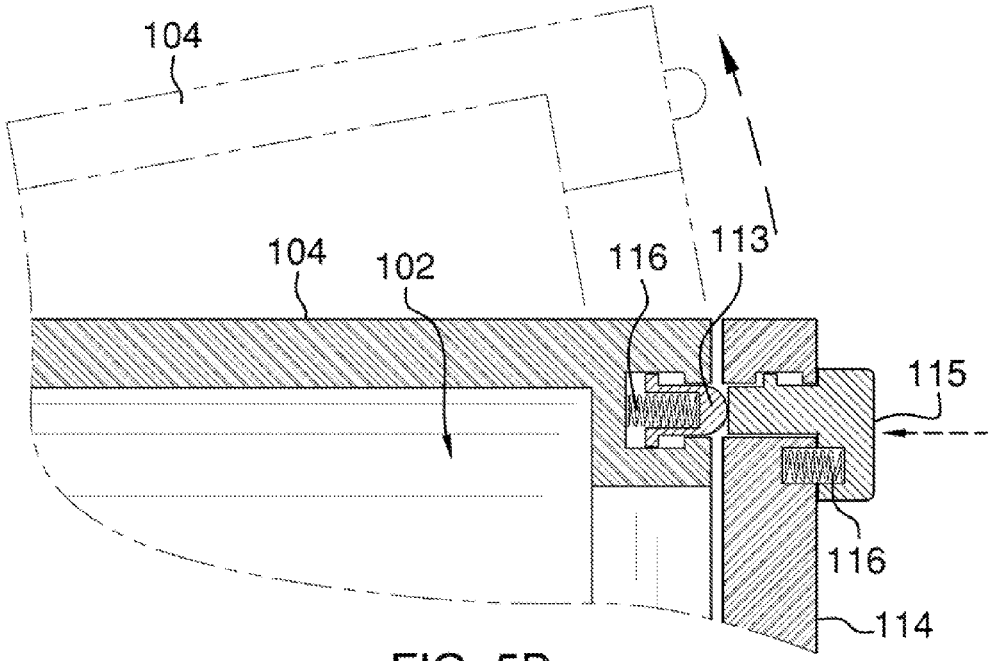
Figure 6A:
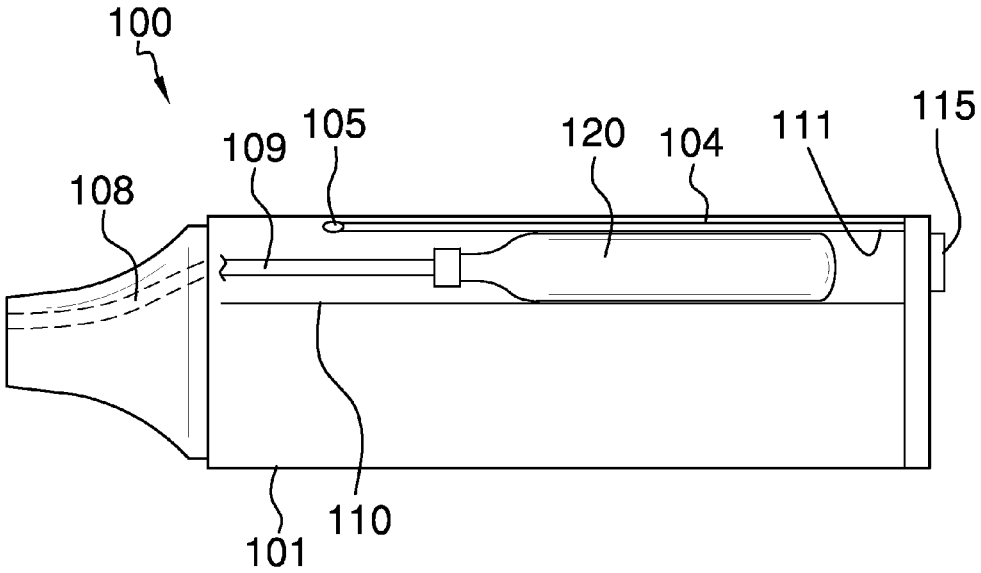
Figure 6B:
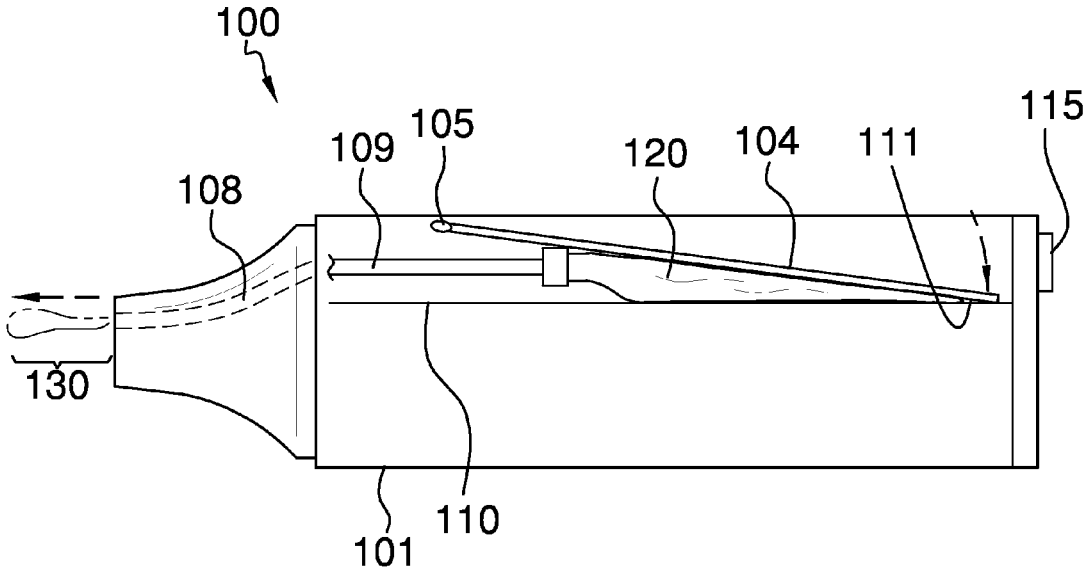

5B illustrates a cross-sectional view along line 5-5 in FIG. 1 wherein the lock button is depressed thereby releasing the lock pin such that the loader door may open outwardly with respect to the housing;

FIG. 6 illustrates another cross-sectional view along the length of one of the condiment compartments whereby the loader door is rotated inwardly in order to squeeze the refill packet contained therein, and thereby dispensing a condiment that travels from the refill packet, through the applicable ductwork, and through the applicable channel of the spout.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A multiple compartmented and condiment dispensing apparatus 100 (hereinafter invention) includes a housing 101 of cylindrical shape and containing a plurality of condiment compartments 102 arranged about a central axis 103. The condiment compartments 102 are essentially cavities of the housing 101 that include a loader door 104 that is attached to and rotates about a pivot point 105. The loader door 104 is able to open outwardly (see FIG. 1 and 5B) as well as inwardly (see FIG. 6) in order to access the condiment compartment 102 and to dispense a condiment 130 therefrom, respectively.

The housing 101 is further defined as including a spout 106 that is provided at a first distal end 106. The spout 106 includes a plurality of channels 108 that are in fluid communication with a respective condiment compartment 102. Moreover, the invention 100 includes duetwork 109 that connects between the channels 108 of the spout 106 to the respective condiment compartment 102. The invention 100 also includes a plurality of refill packets 120 that are individually filled with the condiment 130, and which are further defined as including a refill port 121 that is able to connect with any of the ductworks 109 provided in the condiment compartments 102. Moreover, the refill packets 120 and the condiment compartments 102 shall be of an undefined volume.

Referring to FIG. 6, the condiment compartments 102 shall include an inner wall 110, which interacts with an inner surface 111 of the loader door 104 in order to provide a squeezing action to the refill packet 120 located inside. The loader door 104 is further equipped with a lock in 113, which is spring loaded and extends rearwardly towards a second distal end 114 of the housing 101. The lock pin 113 interacts with a lock button 115 that is provided on the second distal end 114. The lock button 115, like the lock pin 113, includes a spring 116, which biases the respective component rearwardly with respect to the housing 101. Moreover, the depression of the lock button 115 shall unlock the loader door 104 thereby enabling the loader door 104 to rotate outwardly with respect to the housing 101, and thereby enabling retrieval/replacement/installation of the refill packet 120 therein.

It shall be noted that when the condiment compartments 102 are loaded with refill packets 120, the invention 100 may be used to dispense condiments 130 individually or simultaneously. Moreover, the condiments 130 may be squeezed out of the invention 100 upon depressing the respective loader door 104 inwardly as desired.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fail within the spirit and scope of the present invention as defined in the following claims. Accordingly, the invention is to be limited only by the scope of the following claims and their equivalents.

The invention claimed is:

1. A multiple compartmented and condiment dispensing apparatus comprising:

a housing from which a plurality of condiment compartments are provided, and which are each in fluid communication with a spout providing multiple channels;

wherein a plurality of condiments are provided in refill packets that are individually loaded into one of the respective condiment compartments, and from which the condiments are adapted to be individually or simultaneously dispensed therefrom;

wherein the housing is of cylindrical shape and containing a plurality of condiment compartments arranged about a central axis; wherein the condiment compartments each include a loader door that is attached to and rotates about a pivot point;

wherein the loader door is able to open outwardly as well as inwardly in order to access the condiment compartment and to dispense a condiment therefrom, respectively;

wherein the spout is provided at a first distal end;

wherein the channels each connect with ductwork located inside of the condiment compartment, and to which the refill packet connects thereto;

wherein the refill packets each include a refill port capable of connection with the ductwork of the respective condiment compartment;

wherein the condiment compartments include an inner wall, which interacts with an inner surface of the loader door in order to provide a squeezing action to the refill packet located inside;

wherein the loader door is further equipped with a lock pin, which is spring loaded and extends rearwardly towards a second distal end of the housing.

2. The multiple compartmented and condiment dispensing apparatus as described in claim 1 wherein the lock pin interacts with a lock button that is provided on the second distal end of the housing.

3. The multiple compartmented and condiment dispensing apparatus as described in claim 2 wherein the lock button includes a spring, which biases the respective component rearwardly with respect to the housing.

4. A multiple compartmented and condiment dispensing apparatus comprising:

a housing from which a plurality of condiment compartments are provided, and which are each in fluid communication with a spout providing multiple channels;

wherein a plurality of condiments are provided in refill packets that are individually loaded into one of the respective condiment compartments, and from which the condiments are adapted to be individually or simultaneously dispensed therefrom;

wherein the housing is of cylindrical shape and containing a plurality of condiment compartments arranged about a central axis; wherein the condiment compartments each include a loader door that is attached to and rotates about a pivot point;

wherein the loader door is able to open outwardly as well as inwardly in order to access the condiment compartment and to dispense a condiment therefrom, respectively;

wherein the spout is provided at a first distal end;

wherein the channels each connect with ductwork located inside of the condiment compartment, and to which the refill packet connects thereto;

wherein the refill packets each include a refill port capable of connection with the ductwork of the respective condiment compartment;

wherein the condiment compartments include an inner wall, which interacts with an inner surface of the loader door in order to provide a squeezing action to the refill packet located inside;

wherein the loader door is further equipped with a lock pin, which is spring loaded and extends rearwardly towards a second distal end of the housing.

5. The multiple compartmented and condiment dispensing apparatus as described in claim 4 wherein the lock pin interacts with a lock button that is provided on the second distal end of the housing.

6. The multiple compartmented and condiment dispensing apparatus as described in claim 5 wherein the lock button includes a spring, which biases the respective component rearwardly with respect to the housing.

* * * * *